US005682758A

United States Patent [19]

Jones

[11] Patent Number: 5,682,758

[45] Date of Patent: Nov. 4, 1997

[54] METHOD AND APPARATUS FOR COOLING ASPHALT

[75] Inventor: Glenn R. Jones, Sandy, Utah

[73] Assignee: Petro Source Refining Partners, Houston, Tex.

[21] Appl. No.: 240,918

[22] Filed: May 10, 1994

[51] Int. Cl.[6] ..... F25D 17/02

[52] U.S. Cl. ..... 62/374; 264/299; 425/74; 34/393

[58] Field of Search ..... 53/440, 127, 122; 264/316, 299; 34/395, 393, 438, 105; 425/127, 74, 25; 62/374

[56] References Cited

U.S. PATENT DOCUMENTS

| | | | |
|---|---|---|---|
| 1,297,917 | 3/1919 | Schmitt . | |
| 1,666,730 | 4/1928 | Breeze . | |
| 1,670,262 | 5/1928 | Kershaw | 34/393 |
| 2,031,853 | 2/1936 | Potts . | |
| 2,127,401 | 8/1938 | Gillican . | |
| 2,127,402 | 8/1938 | Gillican . | |
| 2,167,392 | 7/1939 | McDonald . | |
| 2,343,906 | 3/1944 | Hothersall et al. | 53/127 |
| 2,378,920 | 6/1945 | Gillican . | |
| 2,664,592 | 1/1954 | Ingraham et al. . | |
| 2,677,151 | 5/1954 | Jennings . | |
| 2,677,152 | 5/1954 | Terry . | |
| 2,709,278 | 5/1955 | Greer . | |
| 2,804,205 | 8/1957 | Barton et al. . | |
| 2,908,936 | 10/1959 | Kilborn . | |
| 2,964,176 | 12/1960 | Lahr . | |
| 3,020,879 | 2/1962 | Podlipnik | 34/105 |
| 3,084,389 | 4/1963 | Doyle . | |
| 3,166,025 | 1/1965 | Hulse . | |
| 3,314,211 | 4/1967 | Wolff . | |
| 3,366,233 | 1/1968 | Roediger . | |
| 3,469,363 | 9/1969 | Berckmoes . | |
| 3,528,143 | 9/1970 | Benecke . | |
| 3,553,303 | 1/1971 | Zavasnik . | |
| 3,564,808 | 2/1971 | Kent . | |
| 3,680,991 | 8/1972 | Cate . | |
| 3,720,037 | 3/1973 | Jones | 53/440 |
| 3,738,019 | 6/1973 | Fory et al. | 34/105 |
| 3,763,661 | 10/1973 | Betschart . | |
| 3,819,793 | 6/1974 | Elliot | 264/316 |
| 3,832,825 | 9/1974 | Dunbar . | |
| 3,837,778 | 9/1974 | Parker . | |
| 3,851,438 | 12/1974 | Brisman . | |
| 4,054,632 | 10/1977 | Franke . | |
| 4,073,760 | 2/1978 | Harris . | |
| 4,100,244 | 7/1978 | Nonaka | 269/237 |
| 4,120,984 | 10/1978 | Richardson et al. | 53/440 |
| 4,126,946 | 11/1978 | Buffington et al. | 34/395 |
| 4,137,692 | 2/1979 | Levy . | |
| 4,209,381 | 6/1980 | Kelly, Jr. | 34/393 |
| 4,306,657 | 12/1981 | Levy . | |
| 4,318,475 | 3/1982 | Robinson . | |
| 4,331,628 | 5/1982 | Ziegler | 264/316 |
| 4,335,560 | 6/1982 | Robinson . | |
| 4,450,133 | 5/1984 | Cafarelli . | |
| 4,627,224 | 12/1986 | Hamamoto . | |
| 4,771,681 | 9/1988 | Nagata . | |
| 4,932,513 | 6/1990 | Michimae et al. . | |
| 5,109,892 | 5/1992 | Somers . | |
| 5,156,791 | 10/1992 | Sano et al. | 264/316 |
| 5,226,269 | 7/1993 | Stoltenberg | 53/433 |
| 5,807,608 | 5/1994 | Muir et al. . | |

FOREIGN PATENT DOCUMENTS

| | | |
|---|---|---|
| 2 140 595 | 2/1973 | Germany . |
| 1 448 246 | 9/1976 | United Kingdom . |

*Primary Examiner*—Daniel Moon
*Assistant Examiner*—Gene L. Kim
*Attorney, Agent, or Firm*—Tobor & Goldstein, L.L.P.

[57] ABSTRACT

An improved apparatus and method for cooling asphalt, which includes a cooling zone, such as a cooling chamber through which coolants such as air and water are blown or drawn, and an elongated conveyor for transporting asphalt molds through said cooling zone after said asphalt molds have been lined with plastic and filled with hot asphalt.

1 Claim, 3 Drawing Sheets

FIG.2
(PRIOR ART)
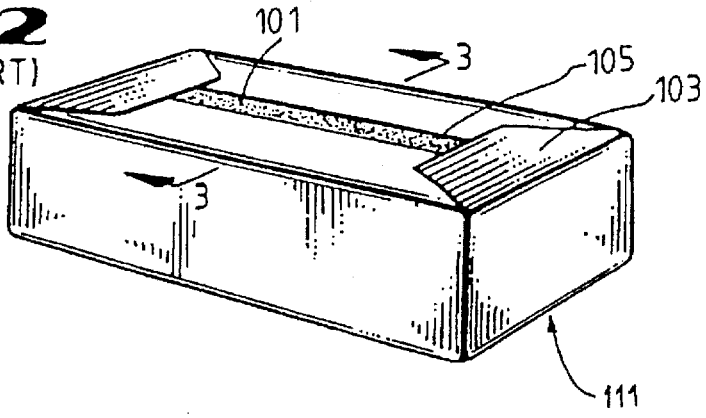
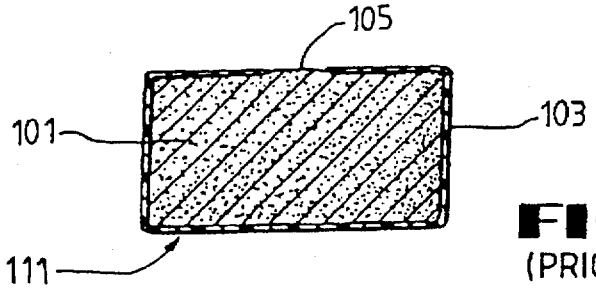
FIG.3
(PRIOR ART)
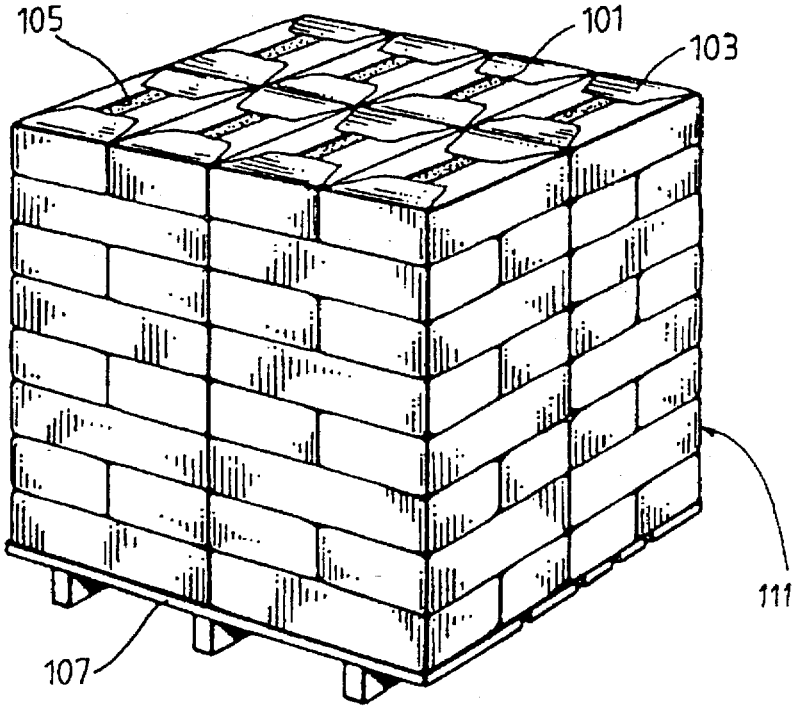
FIG.4
(PRIOR ART)

METHOD AND APPARATUS FOR COOLING ASPHALT

BACKGROUND OF THE INVENTION

A. Field of the Invention

This invention relates to asphalt packaging, in particular to an improved apparatus and method for cooling and packaging asphalt.

B. Related Art

Aspects of the present invention relate generally to the subject matter of commonly assigned U.S. Pat. No. 5,307,608 which is directed to a process and apparatus for packaging asphalt, and which is hereby incorporated by reference.

The method of the referenced patent generally involves the packaging of asphalt, and may include the steps of providing a mold of a rigid material, lining the mold with a flexible film, pouring liquid roofing asphalt into the film-lined mold, cooling the mold to solidify the asphalt, and removing the solidified asphalt covered with the flexible film to provide a packaged asphalt block. The asphalt may be any of a wide variety of asphalts and asphaltic compositions used in roofing applications.

The above-referenced patent provides cooling means and a slanted conveying surface for transporting asphalt filled molds for contact with the cooling means. According to that patent, the cooling means may comprise a liquid coolant, preferably a pool or pond of water but could also include water that is sprayed. The referenced patent also discusses filling the molds with hot asphalt and removing filled molds from the pool.

U.S. Pat. No. 3,837,778 issued to Parker, refers to a packaging method utilizing water troughs. That patent states that hot asphalt is poured into a mold or boat that is lined by polyester film at a charging station. The mold or boat is reportedly floated on a stream of cooling water that carries the boat and its cooling contents to a discharge station where the cooled asphalt enveloped in the resin film is removed from the boat as the packaged product. The boat is then said to be returned to the charging station for reuse.

Shortcomings of systems such as these may include the requirement of a large area upon which to build a pool or trough system. Additionally, the Parker system is elaborate and includes complicated construction. In contrast, by utilizing a conveyor system to carry the molds filled with hot asphalt through a cooling chamber, the present invention presents a more contained and automated system. The present invention is relatively easy to construct and maintain, requires less time to cool and solidify the asphalt than other systems, and requires less operator interaction.

SUMMARY OF INVENTION

The present invention is directed generally to a system for cooling asphalt. The system includes a cooling zone and may also include a substantially planar elongated conveyor for transporting asphalt-filled molds through the cooling zone. In a preferred embodiment of the invention, the cooling zone comprises a cooling chamber through which the asphalt is conveyed and into which coolant is injected. The elongated conveyor preferably comprises parallel chains, belts or conveyors with the molds attached. The system may also include an asphalt dispenser for filling the molds with hot asphalt and means for depositing cooled asphalt from the molds and collecting the asphalt packages.

In a preferred embodiment of the invention, the cooling chamber is vented and air is forced or drawn through the chamber. A coolant dispenser, preferably a spray member such as a spray bar with flat spray nozzles, injects a coolant, preferably water, into the chamber for cooling the asphalt. The water is preferably introduced in the form of a spray. The water spray and the air inside the chamber combine to lower the temperature of the molten asphalt, and then the resulting water vapor and/or mist may be drawn out of the chamber, preferably through the vent. In a preferred embodiment, the cooling dispenser takes the form of water spray bars located and uniformly spaced within the cooling chamber. The water spray bars may be positioned above the conveyor surface such that the water spray is capable of contacting the asphalt in the molds. Water spray bars may also be located at the air entry ways at or near the bottom of the chamber sides. The molds are preferably spaced from one another and suspended at each end from the parallel chains, belts or conveyors such that the coolant air and water spray flow easily and completely around the molds for effective cooling. The water spray is preferably in the form of a fine mist for ready flow through the cooling chamber.

In a general aspect, the invention also concerns a method of packaging asphalt. The method includes transporting asphalt-filled molds through a cooling zone. Advantageously, the asphalt-filled molds may be transported through the cooling zone while on or attached to a conveyor which may be an elongated, substantially planar conveyor. The cooling of the molten asphalt may thus be coordinated with and controlled by moving the mold through the cooling chamber by, for example, adjusting the speed of the conveyor, the conditions in the cooling chamber and/or the size of the molds. The molds are preferably connected to the conveyor and inverted at the end of the conveyor path, thus depositing the cooled asphalt from the molds without the need for handling by operators. In a specific embodiment, the cooled asphalt may be deposited on another conveyor and passed through another cooling zone. The method of a preferred embodiment of the invention additionally includes the steps of lining each mold with a plastic liner and filling the molds with asphalt prior to passing the mold through the cooling zone. The liners are removed from the molds together with the cooled asphalt blocks and serve as wrappers for the blocks.

BRIEF DESCRIPTION OF THE DRAWINGS

FIG. 2 is a perspective view of a package of roofing asphalt.

FIG. 3 is a cross-sectional view of the package of roofing asphalt of FIG. 2.

FIG. 4 is a perspective view of asphalt packages of FIGS. 2 and 3 stacked upon a pallet.

DETAILED DESCRIPTION OF INVENTION

Figure 1:
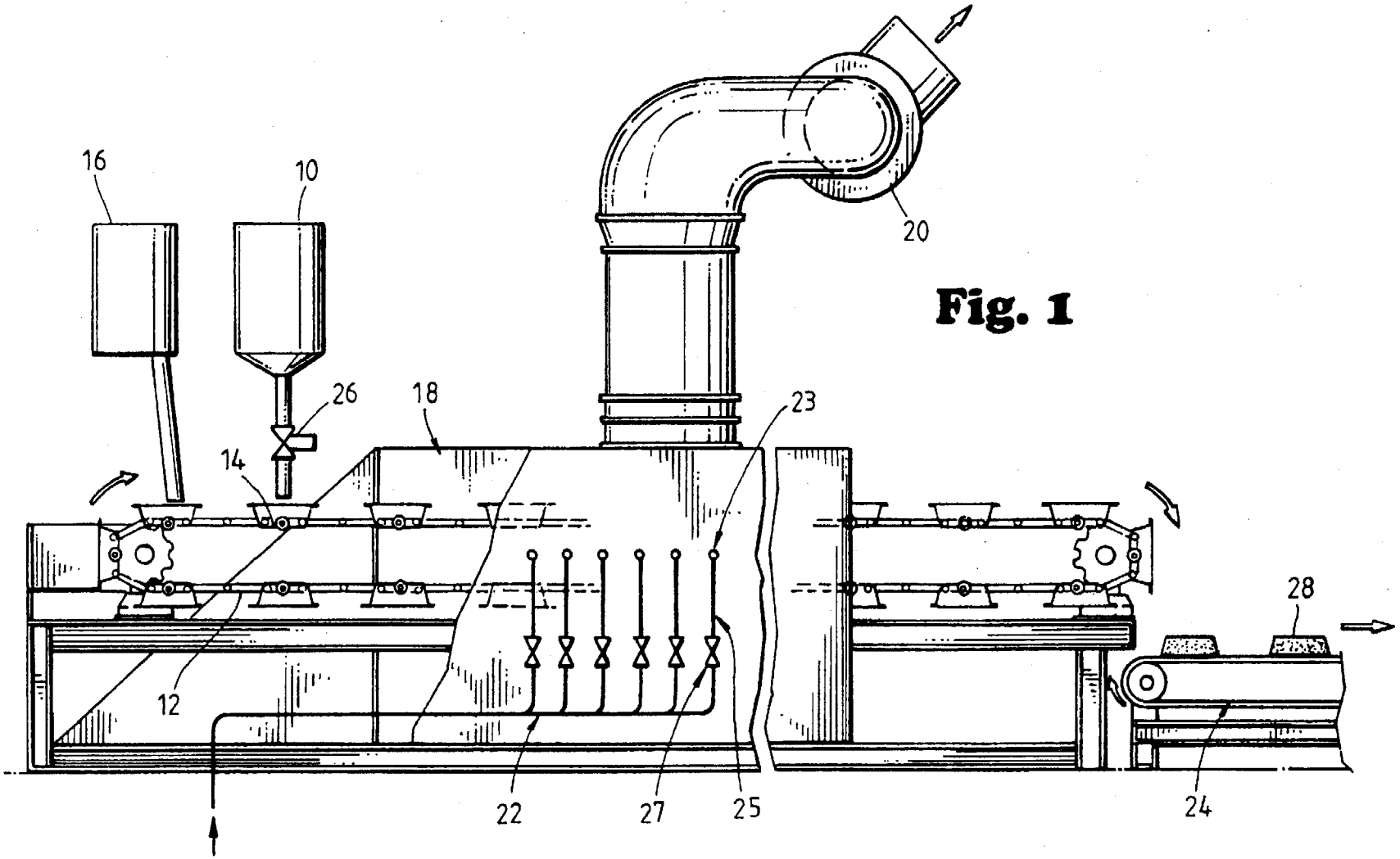
FIG. 1 is a side view of a specific embodiment of a conveyor and cooling assembly of the present invention.

In a broad aspect, the present invention is directed to a unique method and apparatus for cooling asphalt. The method may be carried out in connection with the apparatus. The preferred embodiment and aspects of the apparatus are shown in FIG. 1.

The method and apparatus of the invention are preferably used to provide asphalt packaged in a plastic film. The packaged asphalt itself is the subject of another patent application and will not be discussed in great detail. Briefly, referring to FIGS. 2 and 3, asphalt 101 may be formed into a block and covered by a plastic film 103. The asphalt 101 need not be completely covered by the film 103, but molding techniques usually employed to form packaged asphalt of the invention would generally result in the bottom and the four sides being covered. The packaging may have a portion of the top surface uncovered by the film to expose a surface of asphalt 105. Preferably more than ¾ of the top surface is covered by the film 103. When such packages are stacked on a pallet, the top asphalt surface of a package 111 will adhere to the bottom of an adjacent package, stabilizing the stack. However, packages 111 may still be easily separated and removed when unstacked. FIG. 4 shows the stacking of packages 111 on a conventional shipping pallet 107.

Figure 5A:
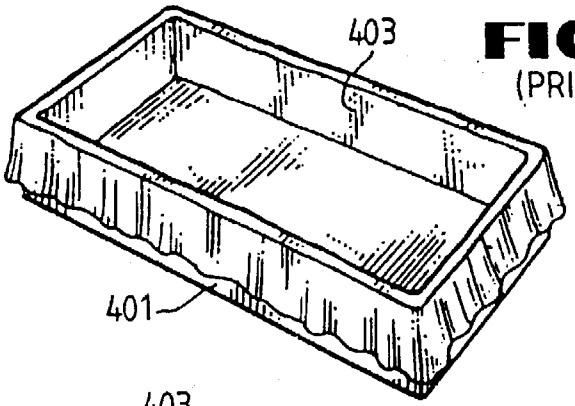
FIG.5A (PRIOR ART)
FIGS. 5A and 5B illustrate the formation of packages of asphalt with a film in the form of a bag lining the mold.
Figure 5B:
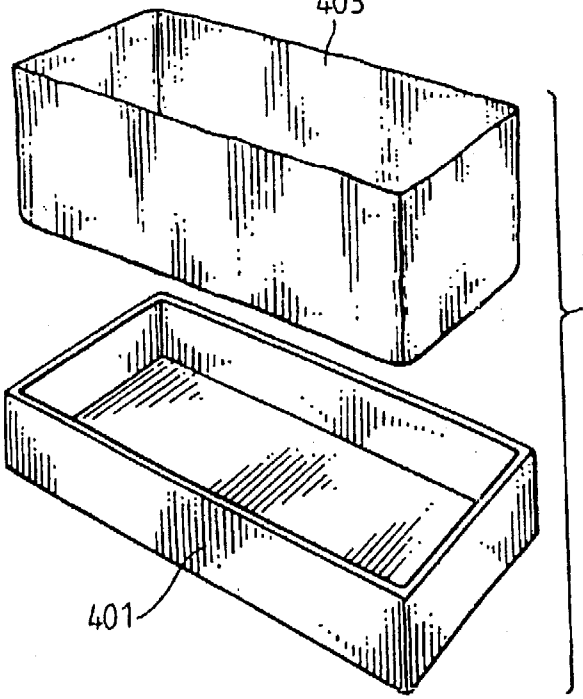
FIG.5B (PRIOR ART)

An asphalt mold 401, typical of that used in the present invention, is illustrated in FIGS. 5A and 5B. A film 403 may be inserted in the mold 401 as shown in FIG. 5B, to line the mold. The mold 401 may be of any suitable material such as heat resistant plastic material, but is preferably sheet or cast metal.

Figure 6:
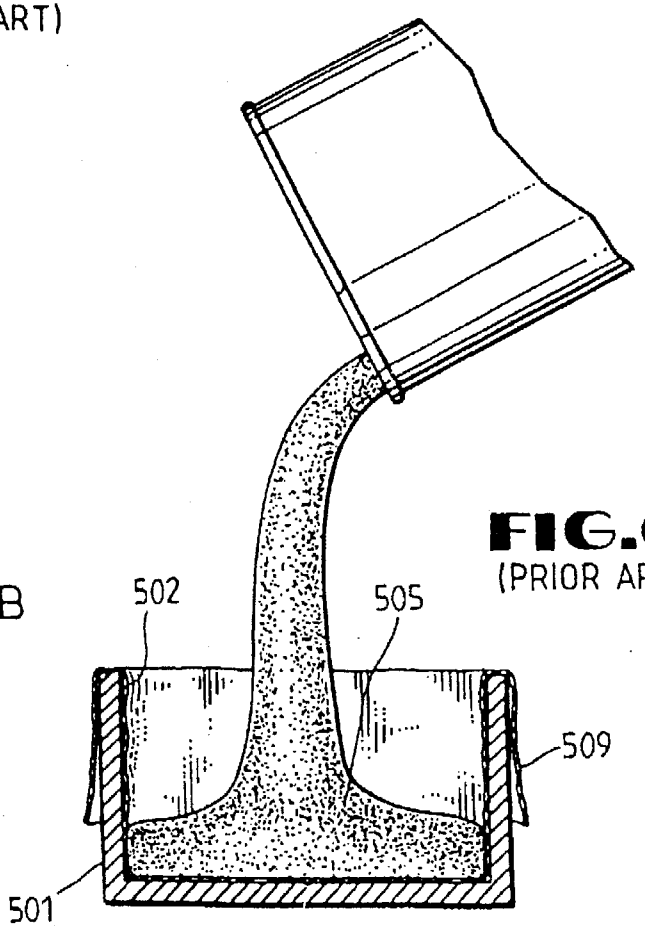
FIG.6 (PRIOR ART)
FIG. 6 is a cross-sectional view of the mold of FIG. 5 with liquid asphalt being poured into the mold.

Asphalt in a liquid form is poured into the mold. FIG. 6 is a cross-section showing mold 501, film 502 lining the mold, and asphalt 505 being poured into the mold 501. A wide variety of asphalts may be cooled by this process of the present invention, each having different melting points. Roofing asphalt, for example, should be poured at a temperature between about 280° F. and 310° F. Below this temperature range the asphalt is generally too viscous, and above this it may damage the film. The optimum temperature range is about 295° F. It will also be recognized by persons skilled in the art that different films may be utilized for different asphalts.

Referring again to FIG. 1, an apparatus relating to a specific embodiment of the invention is schematically shown and comprises an asphalt supply tank 10, a conveyor 12, molds 14, a cooling chamber 18, a coolant dispenser 22, and a product conveyor 24. The coolant dispenser 22 includes conduits 25, valves 27 and spray bars 23.

The asphalt supply tank 10 is supplied from a source of hot asphalt (not shown) and may be heated and insulated as necessary to keep asphalt in a fluid condition. A solenoid valve 26 or other suitable valve may be turned to discharge asphalt from the tank 10 into a mold 14 as the mold moves into filling position. The valve 26 should be calibrated to discharge sufficient asphalt into each mold 14 to fill the mold while it remains in position.

Each mold is preferably lined with packaging material prior to being filled with hot asphalt. Although the liner is preferably a plastic bag made of a single sheet of polypropylene, the composition of the bag is not part of this invention, and other plastics including, but not limited to, polyethylene may also be utilized.

The liners may be placed in the molds 14 by hand such that the molds are lined when they move into filling position. An advantage of placing a liner in the mold is the use of the liner as a package for the hardened asphalt after cooling. The liner is also useful as a means for separating the asphalt block from the mold, and it allows molds to be re-used without first being cleaned. It is also contemplated that a mechanical liner dispenser could be utilized to avoid the necessity of having an operator place the liners in the molds by hand.

An important aspect of the invention is the conveyor. It will be recognized upon reading this patent that a wide variety of conveyor systems may be utilized in conjunction with this invention. In a preferred embodiment, the conveyor 12 includes two parallel chain conveyors. The molds 14 are fastened between and along these two parallel chain conveyors. The parallel chain conveyors should be elongated and substantially level. An advantage of a level conveyor is that the shape of the molded asphalt is substantially rectangular with all sides having approximately the same height. If the conveyor is not level, the molten asphalt tends to collect at the lower ends of the molds resulting in a irregularly shaped brick of solidified asphalt.

The parallel chain conveyors may be laterally spaced from one another such that the distance between the chains is sufficiently wide to accommodate one mold or multiple molds joined together in side-by-side relation. Further, the distance between the chains may be adjusted to accommodate molds having different sizes. In the preferred embodiment, the parallel chain conveyors are laterally spaced approximately 13 feet 4 inches apart from centerline to centerline. Groups of six individual molds are linearly fastened together between, and perpendicular to, these parallel chain conveyors. With specific reference to FIG. 1, the linearly fastened molds are aligned perpendicular to the page; thus, FIG. 1 shows only the molds on the right side of each mold group.

In operation, the conveyor 12 moves the molds 14, which are filled with hot asphalt, into the cooling chamber 18. A coolant dispenser 22 introduces coolant, preferably in the form of a water mist, into the cooling chamber 18. The air and coolant in the cooling chamber 18 may then be forced or drawn out of the cooling chamber by a vapor remover, such as a blower 20, thus lowering the ambient temperature conditions inside the cooling chamber 18.

The blower, cooling pump, and spray nozzles of the present invention are conventional and therefore need not be described in any detail. Generally, in the context of this invention, the blower should be capable of removing the water vapor from the cooling chamber. Such a blower can be obtained from the New York Blower Company or from the A. A. Maycock Company, 336 West 700 South, Salt Lake City, Utah. The pump used to circulate the water through the coolant dispenser may be obtained from Bell & Gossett, 8200 N. Austin Avenue, Morton Grove, Ill.

The conveyor may be operated by an hydraulic drive system (not shown). Alternatively, the conveyor may be driven by other means, including a gasoline or electric motor. Although it is contemplated that a variety of conveyor systems could be used in the present system, the one discussed above and generally illustrated in FIG. 1 is a chain conveyor, which is manufactured by All Hydraulics Inc., located at 555 West 12th Street, Ogden Utah.

In the preferred embodiment, the cooling chamber is between 30 and 50 feet long. The conveyor 12 moves the molds through the cooling chamber 18 at a rate of approximately 2 inches per minute. Water at approximately 60° F. is circulated at a rate of approximately 60 gallons per minute through the chamber 18 with a make-up rate of approximately 3 gallons per minute. The air and water form moist air which is preferably drawn out of the chamber 18 by the blower 20 at a rate of about between 30,000 and 35,000 cubic feet per minute. The coolant dispenser 22 preferably includes a series of spray bars 23. As illustrated in FIG. 1, each spray bar 23 has a separate line 25 with a valve 27. Each valve may be controlled manually or automatically, using conventional valve assemblies. Each spray bar 23 has a series of flat spray nozzles which are also conventional, and available from Rex Nord Incorporated in Milwaukee, Wis.

At the end of the linear traverse of the conveyor 12, the molds 14 become inverted. The cooled asphalt blocks 28 are deposited from the molds 14 onto a product conveyor 24. The molds are recycled around the conveyor and are refilled with liners and asphalt.

The product conveyor 24, upon which the asphalt blocks 28 are deposited, is preferably a linear belt-type conveyor. The product conveyor may transport the asphalt blocks to a location for removal and stacking the asphalt blocks on pallets for transport. Alternatively, the product conveyor may transport the asphalt blocks 28 through the same or another cooling chamber to further cool and solidify the blocks. Generally the product conveyor of this invention should be positioned sufficiently proximate the main conveyor to receive the cooled asphalt packages as they are removed or deposited from the molds, thus avoiding the necessity of operator handling.

While this invention has been described with reference to certain specific examples and embodiments, a person skilled in the art will recognize many variations without departing from the overall invention. For example, it should be understood that the invention is not restricted to the temperature and flow parameters identified above. Persons skilled in the art will recognize from reading this patent specification that different temperatures and flow rates may be required for different designs and systems within this invention.

It is also contemplated that design modifications can be made to the apparatus shown in FIG. 1 while still staying within the scope of the invention. For example, additional cooling conveyors could be added in order to carry the asphalt through the cooling chamber a multitude of times. Such a system could include one or more cooling belt conveyors (not shown) which would be aligned with and positioned below the main conveyor, e.g., the chain conveyor 12 shown in FIG. 1. The first cooling belt conveyor would be located immediately below this main conveyor, and driven in the opposite direction to the main conveyor back through the cooling chamber. Instead of being deposited directly onto the product conveyor for immediate removal and stacking, as shown in FIG. 1, the packaged asphalt could be first deposited on this cooling belt conveyor and transported back through the cooling chamber, where it could be further cooled. A second cooling belt conveyor, located below the first cooling belt conveyor, could then receive the packaged asphalt as it was being deposited off the first cooling belt conveyor. This second cooling belt conveyor, being driven in the opposite direction to the first cooling belt conveyor and in the direction of the main chain conveyor, would transport the asphalt through the cooling chamber a third time. From there, the packaged asphalt could be deposited onto a product conveyor such as the conveyor 24 shown in FIG. 1.

What is claim is:

1. An apparatus for cooling and packaging molten asphalt, comprising:

an asphalt supply tank;

at least one mold conveyor, comprising two elongated, substantially level and spaced-apart parallel chains;

one or more molds, the molds being lined with a plastic liner having a higher melting point than the molten asphalt, the molds being fixedly attached to, between, and along the two parallel chains of the mold conveyor and adapted to receive and contain the asphalt;

a valve adapted to discharge the asphalt stored in the supply tank into the lined molds;

a cooling chamber, including a housing through which the mold conveyor transports the molds containing molten asphalt to cool the asphalt contained within the molds, the housing having an open end for receiving the mold conveyor and the lined molds containing molten asphalt affixed thereto;

a water dispenser, including a water pump, a series of spray bars, and a series of flat spray nozzles disposed in communication with each spray bar, the water dispenser introducing a mist of water in the form of a spray into the cooling chamber in an amount sufficient to lower the temperature of the molten asphalt within the molds to form cooled asphalt blocks each having a top surface, the liner being adapted to cover at least a portion of the top surface of the cooled asphalt blocks, said spray forming water vapor in the form of steam upon contact with the molds or molten asphalt contained within the molds;

a water vapor remover, including a conduit disposed in communication with the housing and a blower disposed in communication with the conduit for removing the water vapor from the cooling chamber and directing the removed water vapor to the atmosphere to lower the ambient temperature conditions inside the cooling chamber; and a linear belt-type product conveyor, the mold conveyor being adapted to invert the molds affixed thereto to deposit the cooled asphalt blocks onto the product conveyor, the product conveyor being adapted to transport the cooled asphalt blocks to a location for removal and stacking the asphalt blocks on pallets for transport.

* * * * *